US007231155B2

(12) United States Patent
Suzuki

(10) Patent No.: US 7,231,155 B2
(45) Date of Patent: Jun. 12, 2007

(54) IMAGE FORMING APPARATUS WITH A POWER CONTROLLED FLUX GENERATOR AS A FUNCTION OF A DETECTED TEMPERATURE OF AN IMAGE BEARING SURFACE

(75) Inventor: Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 11/174,539

(22) Filed: Jul. 6, 2005

(65) Prior Publication Data

US 2006/0088325 A1 Apr. 27, 2006

(30) Foreign Application Priority Data

Oct. 27, 2004 (JP) ..... 2004-312483

(51) Int. Cl.
*G03G 15/00* (2006.01)

(52) U.S. Cl. ..... 399/44; 399/96

(58) Field of Classification Search ..... 399/44, 399/96, 159; 355/30; 219/619, 643
See application file for complete search history.

(56) References Cited

U.S. PATENT DOCUMENTS 4,720,727 A * 1/1988 Yoshida ..... 399/93
5,019,862 A * 5/1991 Nakamura et al. ..... 399/44
5,300,987 A * 4/1994 Aoyama et al. ..... 399/96

FOREIGN PATENT DOCUMENTS

| | | | |
|---|---|---|---|
| JP | 92229177 A | * | 10/1987 |
| JP | 01211768 A | * | 8/1989 |
| JP | 1-233474 | | 9/1989 |
| JP | 01238677 A | * | 9/1989 |
| JP | 07104638 A | * | 4/1995 |
| JP | 09106137 A | * | 4/1997 |
| JP | 9-319100 | | 12/1997 |
| JP | 2002-208068 | | 7/2002 |

* cited by examiner

*Primary Examiner*—Robert Beatty
(74) *Attorney, Agent, or Firm*—Fitzpatrick, Cella, Harper & Scinto

(57) ABSTRACT

An image forming apparatus includes an image bearing member; an image forming device for forming an image on the image bearing member through steps including a step of electrically charging the image bearing member to a substantially uniform potential, wherein the image bearing member is repeatedly usable for forming images; and a heating device, disposed adjacent to the image bearing member, for locally heating the image bearing member.

3 Claims, 7 Drawing Sheets

IMAGE FORMING APPARATUS WITH A POWER CONTROLLED FLUX GENERATOR AS A FUNCTION OF A DETECTED TEMPERATURE OF AN IMAGE BEARING SURFACE

FIELD OF THE INVENTION AND RELATED ART

The present invention relates to an image forming apparatus such as a copying machine, a printer, or the like, which employs a single or multiple image bearing members such as an electrophotographic photosensitive member, an electrostatically writable dielectric member, the likes and forms images with the use of one of such image formation processes as the electrophotographic and electrostatic recording processes, which include the step of uniformly charging the image bearing member, while repeatedly using the image bearing member.

More specifically, the present invention relates to an image forming apparatus which is substantially smaller in the effects of the byproducts of the electrical discharge which repeatedly occurs between the image bearing member (s) and charging means of the image forming apparatus, is lower in energy consumption, and is more reliable than an image forming apparatus in accordance with the prior art When forming images with the use of an electrophotographic image forming apparatus for example, the image forming process comprising a charging step, an exposing step, a developing step, a transferring step, and a cleaning step, is repeatedly carried out while the cylindrical photosensitive member(s) as an image bearing member(s) is continuously rotated. As for the choices of a photosensitive member, a rotational drum comprising an electrically conductive cylindrical substrate and a photosensitive layer coated on the substrate is most widely in use. For durability, the surface of a photosensitive member needs to be high in hardness. Therefore, amorphous silicon or the like, which is very difficult to shave, is used as the material for the photosensitive layer.

An image forming apparatus which employs a photosensitive member and forms images with the use of the image formation process inclusive of the step for uniformly charging the peripheral surface of the photosensitive member suffers from the following problem. That is, as an image forming operation is continued, the image forming apparatus gradually reduces in image quality in that it begins to yield images suffering from a defect called a slur, that is, a spot that appears blurred or unclear like a picture of "flowing water".

As one of the main causes of a slur, it can be listed that the byproducts, such as ozone, nitrogen oxides, and the like, of the electrical discharge (corona discharge) which occurs when a photosensitive drum is charged by a charging device, adhere to the peripheral surface of the photosensitive member, and/or change the properties of the peripheral surface of the photosensitive member. The byproducts of electrical discharge are hygroscopic. Thus, their adhesion to the peripheral surface of the photosensitive member increases the amount of moisture on the peripheral surface of the photosensitive member, which in turn causes the paper dust from recording paper (object across which recording is made), toner, and the like to adhere to the peripheral surface of the photosensitive member, contaminating thereby the peripheral surface of the photosensitive member. Such contamination reduces the surface portion of the photosensitive member in electrical resistance This electrical resistance reduction in the surface portion of the photosensitive member progresses with the continuation of image formation, eventually resulting in the formation of images suffering from the abovementioned slurs.

As for a charging device of the corona discharge type, which is widely used as a device for charging a photosensitive drum, it is disposed next to a photosensitive drum, with its corona discharging opening facing the peripheral surface of the photosensitive member and with no contact between the photosensitive member and charging device. As high voltage is applied to the charging device, corona is discharged onto the peripheral surface of the photosensitive member through the corona discharging opening. As a result, the peripheral surface of the photosensitive member is uniformly charged to predetermined polarity and potential level. Corona discharge is distinctive in that it yields a large amount of byproducts attributable to electrical discharge (corona discharge), which is one of the causes of the formation of images suffering from the abovementioned slurs.

Japanese Laid-open Patent Application 1-233474 discloses a proposal for heating a photosensitive drum, in a general sense, with the use of various heat sources. However, this proposal lacks details and is not realistic.

Japanese Laid-open Patent Application 2002-208068 discloses another proposal for solving the above described problem. According to this proposal, the formation of images suffering from the slurs is reduced by maintaining the ability of the peripheral surface of a photosensitive member to hold electrical charge by polishing the peripheral surface of a photosensitive member with a cleaning member which contains abrasive, so that not only is the toner remaining on the peripheral surface of the peripheral surface of the photosensitive member after the transfer of a toner image, removed from the peripheral surface of the photosensitive member, but also, the electrical discharge byproducts having adhered to the peripheral surface of the photosensitive member are shaved away to renew the peripheral surface of the photosensitive member.

However, the byproducts resulting from electrical discharge (corona discharge) remain floating in the adjacencies of a charging device, and then, adhere to the charging device and/or the portion of the peripheral surface of a photosensitive member in the adjacencies of the charging device after the rotation of the photosensitive member stops (for example, during the night). Therefore, it is immediately after the starting of the an image forming operation (first image forming operation in the morning) that an electrophotographic image forming apparatus sometimes yields defective images, the slur portions of which correspond in position to the portions of the peripheral surface of the photosensitive drum, which were in the adjacencies of the charging device, that is, the portions of the peripheral surface of the photosensitive drum, to which the byproducts of the electrical discharge adhered.

SUMMARY OF THE INVENTION

Thus, the primary object of the present invention is to provide an image forming apparatus which employs a single or multiple image bearing members, and forms images using one of the image formation processes which include the step for uniformly charging the image bearing member, while repeatedly using the image bearing member for image formation, and which is characterized in that it more efficiently dries its image bearing member(s), is substantially lower in energy consumption, and more reliable than an image forming apparatus in accordance with the prior art.

According to an aspect of the present invention, there is provided an image forming apparatus comprising an image bearing member; image forming means for forming an image on said image bearing member through steps including a step of electrically charging said image bearing member to a substantially uniform potential, wherein said image bearing member is repeatedly usable for forming images; and heating means, disposed adjacent to said image bearing member, for locally heating said image bearing member.

The employment of the above described structural arrangement makes it possible to localize the heating of an image forming apparatus by a heating means, to the portion of the image bearing member, which is facing a charging means, and the portions of the image bearing member adjacent to this portion. Therefore, it is possible to provide an image forming apparatus which is more efficient in drying the peripheral surface of its image bearing member having increased in moisture content due to the adhesion thereto of the byproducts of the electrical discharge, is smaller in energy consumption, and more reliable than an image forming apparatus in accordance with the prior art.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in more detail. Incidentally, the following embodiments of the present invention are not intended to limit the scope of the present invention.

Embodiment 1

(1) Example of Image Forming Apparatus

Figure 1:
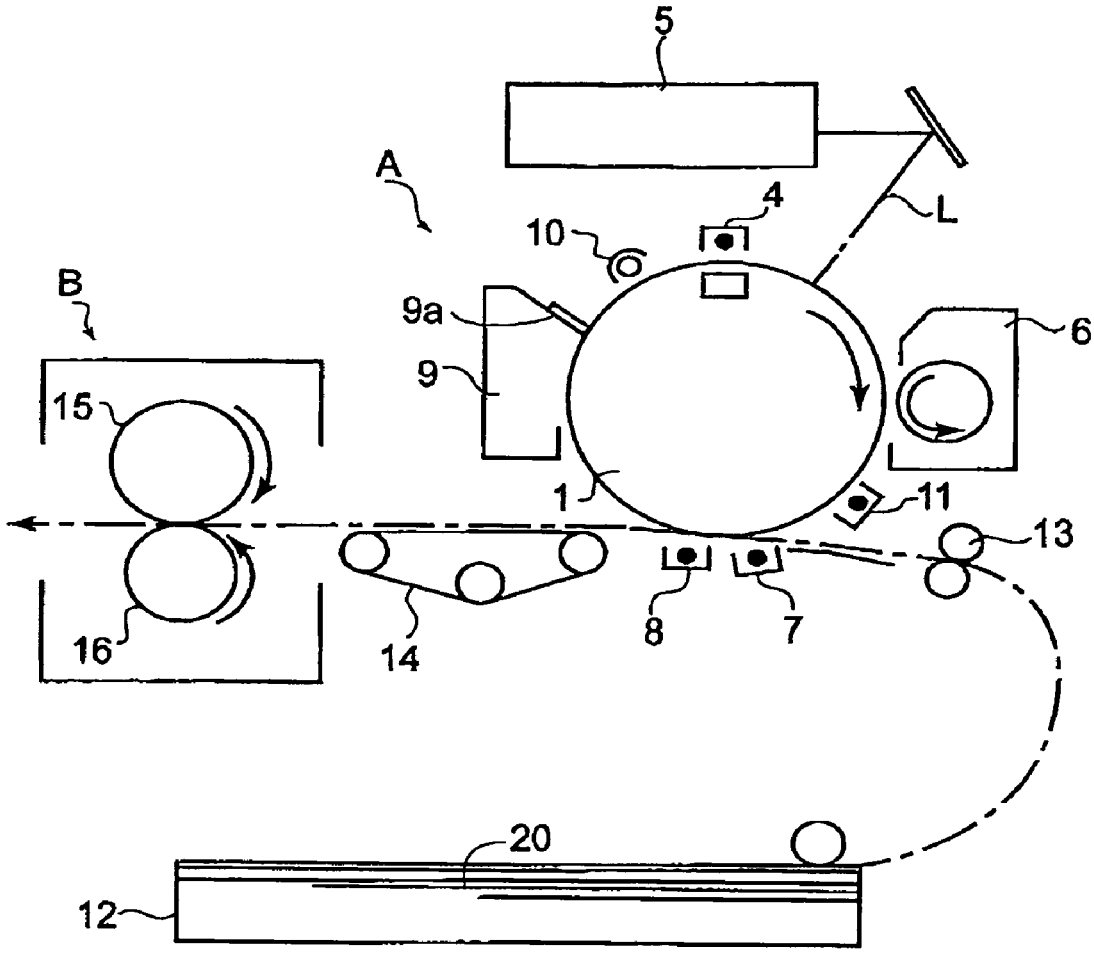
FIG. 1 is a schematic sectional view of the image forming apparatus in the first embodiment of the present invention, showing the general structure thereof.

FIG. 1 is a schematic drawing of a typical image forming apparatus to which the present invention is very effectively applicable. This image forming apparatus (copying machine, printer, etc.) is such an image forming apparatus that employs, as its image formation process, one of the electrophotographic processes of the transfer type which includes one of the exposing methods which expose an image bearing member by scanning the image bearing member with the use of a beam of laser light.

Referring to FIG. 1, designated by a referential symbol A is the image forming portion of the image forming apparatus, which comprises an electrophotographic photosensitive member 1 (which hereinafter may be referred to simply as photosensitive member) as an image bearing member, which is in the form of a rotatable cylindrical drum. Disposed in the adjacencies of the peripheral surface of this photosensitive member 1 are a primary charging device 4, an exposing apparatus 5, a developing apparatus 6, a post-charging device 11, a transfer charging device 7, a separation charging device 8, a cleaning apparatus 9, and a pre-exposing apparatus 10.

Figure 2:
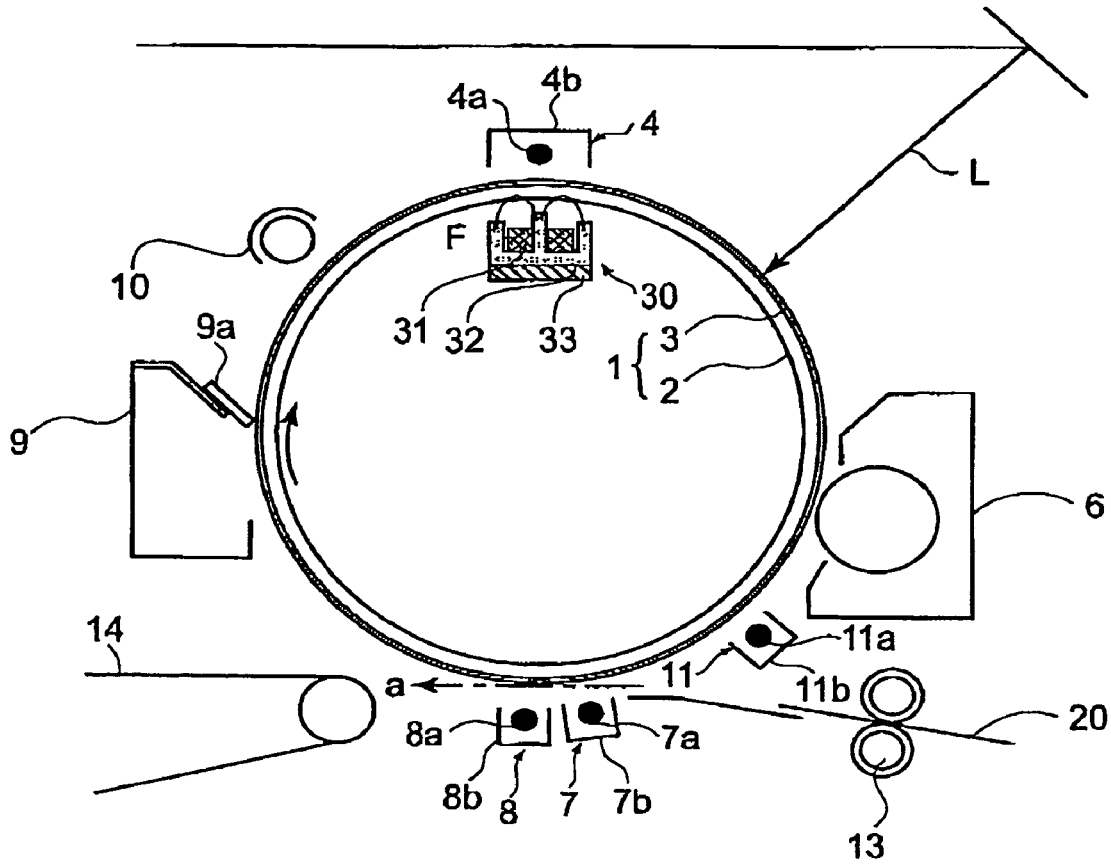
FIG. 2 is a schematic vertical cross-sectional view of the image forming portion of the image forming apparatus in the first embodiment of the present invention, showing the general structure thereof.

Referring to FIG. 2, the photosensitive member 1 in this embodiment is made up of a substrate 2 and a photosensitive layer 3. The substrate 2 is in the form of a cylinder, and is formed of an electrically conductive metal. The photosensitive layer 3 is formed of amorphous silicon or the like, and covers virtually the entirety of the peripheral surface of the substrate 3. The photosensitive member 1 is rotationally driven in the clockwise direction indicated by an arrow mark, at a predetermined peripheral velocity. As it is rotationally driven, it is uniformly charged by the primary charging device 4 to predetermined polarity and potential level. The uniformly charged portion of the peripheral surface of the photosensitive member 1 is exposed to the beam of exposure light L projected from the exposing apparatus 5. As a result, numerous points of the uniformly charged portion of the peripheral surface of the photosensitive member 1 are reduced in potential level by the exposure (by being illuminated by beam of exposure light L). Consequently, an electrostatic latent image, the pattern of which matches the exposure pattern, emerges on the peripheral surface of the photosensitive member 1.

The exposing apparatus 5 in this embodiment is a laser scanner. It forms, on the uniformly charged portion of the peripheral surface of the photosensitive member 1, an electrostatic latent image, by scanning the uniformly charged portion, with a beam of laser light L which it outputs while modulating the beam of laser light L with video signals generated by an unshown control portion (CPU) as the control portion processes the image formation data.

Then, the electrostatic latent image is developed by the developing apparatus 6 into a visible image, that is, an image formed of toner (which hereinafter will be referred to simply as toner image). The portion of the peripheral surface of the photosensitive member 1 having been developed by the developing apparatus 6 with the use of toner is charged by the post-charging device 11 to predetermined polarity and potential level in order to increase the toner image in the amount of electrical charge so that it will be easier for the toner image to be transferred onto a transfer medium.

Meanwhile, a sheet 20 of transfer medium (sheet onto which toner image is transferred) is sent by a feed roller 13 from a sheet feeder cassette 12 which is holding multiple (inclusive of single) sheets 20 of transfer medium such as recording paper, OHP sheet, and the like, into the interface between the photosensitive member 1 and the transfer charging device 7. Then, the portion of the peripheral surface is of the photosensitive member 1, which has the toner image and has been subjected to the abovementioned post-charging process, is charged by the transfer charging device 7 through the sheet 20 of transfer medium to transfer the toner image onto the surface of the sheet 20 of transfer medium.

The portion of the peripheral surface of the photosensitive member 1, from which the unfixed toner image has just been transferred onto the sheet 20 of transfer medium, is charged to predetermined polarity and potential level in order to cause the sheet 20 of transfer medium to separate from the peripheral surface of the photosensitive member 1. After being separated from the peripheral surface of the photosensitive member 1, the sheet 20 of transfer medium is conveyed to the fixing apparatus B by a conveyer belt 14. In the fixing apparatus B, the unfixed image on the sheet 20 of transfer medium is subjected to pressure and heat by a thermal fixing member 15 having a heat source, and a pressing member 16 kept pressed upon the thermal fixing member 15. As a result, the unfixed image is fixed to the sheet 20 of transfer medium. Then, the sheet 20 of transfer medium is discharged onto an unshown delivery tray.

Each of the abovementioned charging devices 4, 6, 7, and 11 as charging means are devices for causing electrical discharge (corona discharge), which are charging devices of the noncontact type. As for their operations, bias is applied from a charge bias power source(s) (unshown) to discharge wires 4*a*, 6*a*, 7*a*, and 11*a*, causing thereby electrical discharge (corona discharge) in order to charge the portion of the peripheral surface of the photosensitive member 1, which is facing the opening of the shielding members 4*b*, 6*b*, 7*b*, and 11*b* disposed in a manner to surround the discharge wires 4*a*, 6*a*, 7*a*, and 11*a*, to predetermined polarities and potential levels, respectively (charging by corona discharge).

After the separation of the sheet 20 of transfer medium, the portion of the peripheral surface of the photosensitive member 1, from which the transfer medium 20 has just been separated, is cleaned, that is, cleared of adhesive contaminants such as the transfer residual toner and the like. More specifically, not only is the toner remaining on the portion of the peripheral surface of the photosensitive member 1, from which the toner image has just been transferred, removed by the cleaning member 9*a* containing abrasive, but also, the portion is abraded by the cleaning member 9*a* to shave away the adhesive byproducts resulting from the corona discharge. As a result, this portion of the peripheral surface of the photosensitive member 1 is renewed, and then, is cleared of electrical charge by being exposed by the pre-exposing apparatus 10, so that it can be used for the following image formation cycle.

(2) Image Forming Portion A

Figure 3:
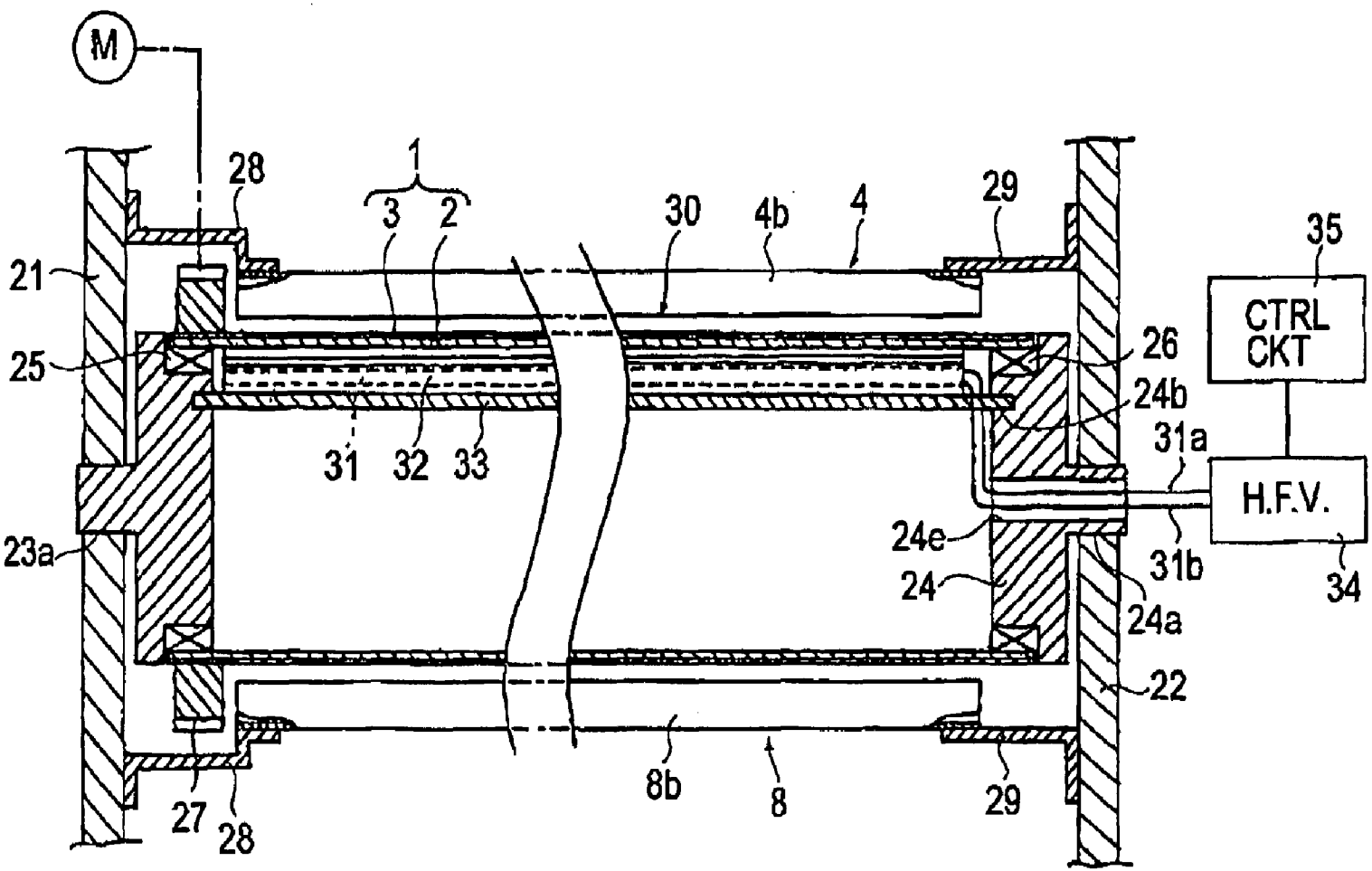
FIG. 3 is a schematic vertical sectional view of the image formation portion of the image forming apparatus in the first embodiment of the present invention, at the vertical plane which coincides with the axial line of the image bearing member, showing the general structure thereof.
Figure 4:
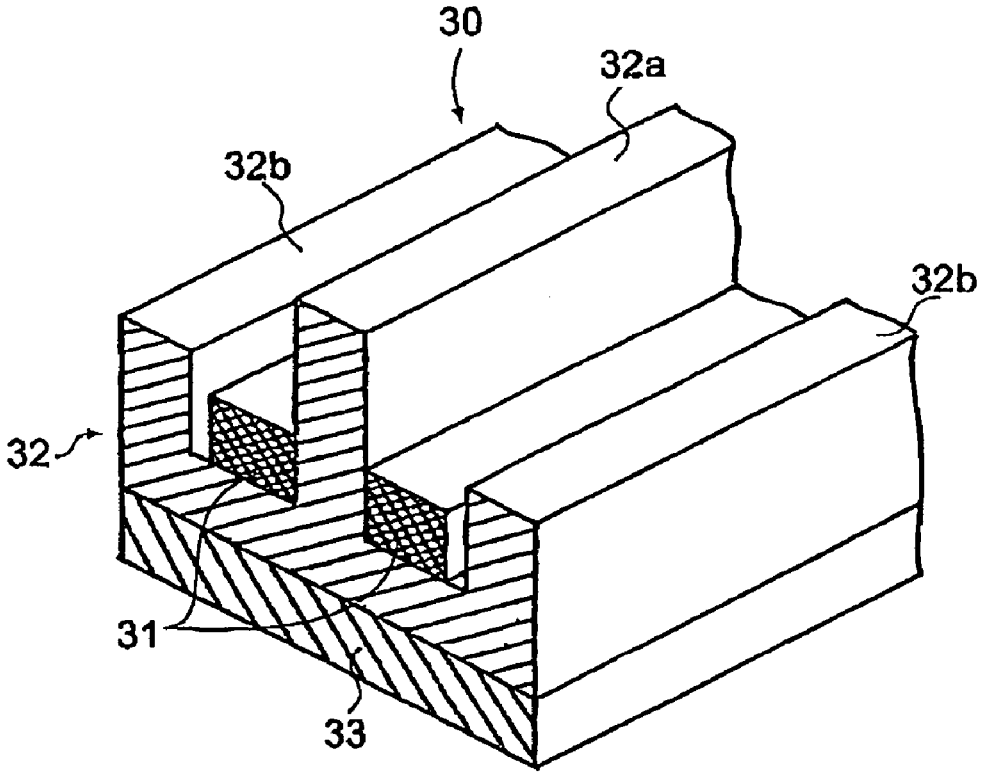
FIG. 4 is an enlarged perspective view, inclusive of a vertical cross-sectional view, of the magnetic field generating means.

FIG. 2 is a schematic vertical sectional view of the image forming portion A of the image forming apparatus in this embodiment, showing the general structure thereof. FIG. 3 is a schematic vertical sectional view of the image forming portion A shown in FIG. 2, at the vertical plane which coincides with the axial line of the photosensitive member 1. FIG. 4 is an enlarged perspective view, inclusive of a vertical sectional view, of the magnetic field generating means.

In the following description of the structural components, portions, etc., of the image forming portion A, the lengthwise direction means the direction (parallel to axial line of photosensitive member) perpendicular (intersectional) to the transfer medium conveyance direction a, that is, the direction in which the sheet 20 of transfer medium is conveyed along the surface of the transfer medium conveyance passage.

The lengthwise ends of the photosensitive member 1 are supported by the internal front 21 and rear plates 22 of the image forming apparatus, with the interposition of a pair of flanges 23 and 24, respectively. More specifically, a part of each of the flanges 23 and 24 is fitted in the corresponding lengthwise end of the substrate 2 of the photosensitive member 1, with a bearing 25 (26) disposed between the flange 23 (24) and the lengthwise end of the substrate 2. The portion of the flange 23 (24) opposite from the lengthwise end of the substrate 2 is fitted in the hole 23*a* (24*a*) of the front plate 21 (rear plate 22), respectively, being thereby solidly attached thereto. Around one of the lengthwise ends of the substrate 2 of the photosensitive member 1, a ring gear 27 for rotationally driving the photosensitive member 1 is fitted. As this gear 27 is rotationally driven by a driving system M, rotational force is transmitted to the photosensitive member 1. As a result, the photosensitive member 1 rotates in a predetermined direction.

The shielding members 4*b* and 8*b* or the primary charging device 4 and separation charging device 8*b*, respectively, are supported by the aforementioned front and rear plates 21 and 22 of the image forming apparatus; the lengthwise ends of the shielding member 4*b* (8*b*) are attached to the shielding member supporting members 28 and 29, one for one, which are attached to the front and rear plates 21 and 22, respectively. Although FIG. 3 shows only the primary and separation charging devices 4 and 8, the transfer charging device 7 and post-charging device 11 are also attached by their lengthwise ends to the shielding member supporting members 28 and 29, which are attached to the front and rear plates 21 and 22, respectively, of the image-forming apparatus.

Designated by a referential number 30 is a magnetic flux generating means (which hereinafter will be referred to as magnetic field generating means), which is made up of an exciter coil 31, a core 32, and a holder 33, which are integrated. The magnetic field generating member 30 is long and narrow, and is disposed within the hollow of the substrate 2 of the photosensitive member 1, and also, in the adjacencies of the primary charging device 4, so that the magnetic flux from the magnetic field generating means 30 concentrates to the portion of the substrate 2 in the adjacencies of the primary charging device 4. Incidentally, shaping the coil 32 so that it conforms to the internal surface of the substrate 2 of the photosensitive member 1 makes it possible to eliminate the core 32. More concretely, the magnetic field generating means 30 is disposed in the hollow of the photosensitive member 1. While the photosensitive member 1 is cylindrical, the cross section of the core 32 is in the shape of a letter E. The center portion 32*a* of the core 32 is rendered taller than the lateral portions 32*b* (FIG. 4) so that the core 32 roughly conforms to the internal surface of the substrate 2. The material for the core 32 is desired to be high in permeability, and therefore, ferrite, silicon steel, and the like, for example, are most suitable as the material for the core 32.

The exciter coil 31 is wound a predetermined number of times around the center portion 32*a* of the core 32 so that the overall shape of the exciter coil 31 also conforms to the internal surface of the substrate 2. The exciter coil 31 is required to produce an ample amount of alternating magnetic flux under the heated condition. Therefore, it needs to be low in resistance and high in inductance. As the material for the exciter coil 31, a litz wire is used, which is a wire made up by binding a number of fine insulated strands of wire, the diameter of which are in the range of 0.1-1.0 mm.

The holder 33 is roughly rectangular in the cross section perpendicular to its lengthwise direction. The material for the holder 33 has only to be electrically insulating and have a certain amount of mechanical strength. For example, resin, glass, ceramic, and the like are suitable therefor. They are not used for the fixing device. That is, they are used in the low temperature environment. Further, the core 32 may be thick, and the heat resistance of resin does not need to be as high as that for the material for the fixing device. In other words, all that is required of the materials for the holder 33 in terms of heat resistance is that their levels of heat resistance are higher than the temperature level (range of 40-50° C., although variable depending on toner properties) to which the photosensitive member 1 is heated.

The magnetic field generating member 30 is disposed in the adjacencies of the primary charging device 4. In this embodiment, it is disposed in the portion of the hollow of the photosensitive member 1, which is in the adjacencies of the primary charging device 4. More specifically, the magnetic field generating member 30 is disposed so that the coil 31 is on the primary charging device side, with the wall of the photosensitive member 1 positioned between the coil 31 and primary charging device 4, with no contact between the photosensitive member 1 and coil 31. The distance between the exciter coil 31 and substrate 2 is no more than 3 mm. In order to hold the magnetic field generating member 30 in the above described position, the lengthwise ends of the holder 33 are immovably fitted in a pair of grooves 23*b* and 24*b*, with which the internal surfaces of the flanges 23 and 24 are provided, respectively. Designated by referential symbols 31*a* and 31*b* are lead wires of the exciter coil 31. The lead wires 31*a* and 31*b* are extended outward through the hole 24*c* of the flange 24, and are connected to a high frequency power source 34.

The high frequency power source 34 is turned on with a predetermined control timing, which is controlled by a control circuit portion 35 (CPU) according to the image formation sequence; it is turned on while the photosensitive member 1 is not being used for an actual image forming operation, for example, during the night, or when the image forming apparatus is kept on standby. The high frequency power source 34 supplies the exciter coil 31 with alternating current of high frequency (10 k-200 kHz) for a predetermined length of time, according to the predetermined control timing. As the exciter coil 31 is supplied with alternating current of high frequency, it generates alternating magnetic flux F, which concentrates to the portion of the photosensitive member 1, which is in the adjacencies of the primary charging device 4, and the portions of the photosensitive member 1 adjacent to this portion of the photosensitive member 1, inducing thereby heat in this portion and its adjacencies. As a result, this portion (inclusive of adjacent portion of photosensitive member 1 thereto) is heated (to roughly 40° C., for example). As for the principle of induction heating, as a piece of metal is placed in a magnetic field, current (eddy current) is induced in the metal in the direction to oppose the magnetic field, and the interaction between this current and the resistance of the metal induces heat (Joule heat). Thus, as long as the material of the substrate 2 of the photosensitive member 1 is a metal, the photosensitive member 1 can be heated by induction. Incidentally, when a ferromagnetic substance such as iron, nickel, and the like is used as the material for the substrate 1, it is far easier to heat the photosensitive member 1. With the generation of heat in the portion of the photosensitive member 1 in the adjacencies of the primary charging device 4, that is, the portion of the photosensitive member 1 which has increased in moisture content due to the adhesion thereto of the byproducts of electrical discharge, this portion becomes dry, preventing thereby the problem that immediately after the rotation of the photosensitive member 1 is started for image formation (for example, when image forming apparatus is used first time in the morning, when image forming apparatus is used first time after it is kept on standby, and the like situations), images suffering from the slurs, which correspond in location to the portion of the peripheral surface of the photosensitive member 1 in the adjacencies of the primary charging device, that is, the portion to which the byproducts of the electrical discharge have adhered, are yielded.

In the case of the image forming apparatus in this embodiment, the magnetic field generating member 30 is disposed so that there is no contact between the magnetic field generating member 30 and photosensitive member 1. Therefore, the method in this embodiment for heating the photosensitive member 1 is substantially smaller in the amount of load borne by the motor (unshown) for driving the photosensitive member 1 than the photosensitive member heating method, proposed in Japanese Laid-open Patent Application 9-319100 or the like, according to which a heater in the form of a sheet is placed in contact with the internal surface of the photosensitive member 1. Besides, in the case of the photosensitive member heating method which employs a heater in the form of a sheet, generally, power (100 V of alternating current for example) is supplied to the heater by disposing a heater power source in the hollow of the photosensitive member 1 and slidably placing the primary power supply electrode in contact with the internal surface of the photosensitive member 1. In comparison, in this embodiment, power is supplied to the magnetic field generating member 30 through the lead wires 31*a* and 31*b* of the exciter coil 31, which are extended outward from one of the lengthwise ends of the photosensitive member 1 and connected to the high frequency power source 34 with the use of connectors, screws, or the like means, which ensures good connection. With the employment of this structural arrangement, not only is it assured that the magnetic field generating member 30 is supplied with power, but also, the structural arrangement for rotating the high frequency power source 34 with the photosensitive member 1 is unnecessary. Therefore, this embodiment also improves the image forming apparatus in reliability in terms of the electrical junctions among the various components attached to the substrate 2. Incidentally, the distance between the substrate 2 and magnetic field generating member 30 is desired to be no more than 3 mm. Increasing the distance to a value greater than 3 mm reduces the heating means in heating efficiency.

In this embodiment, the high frequency power source 34 is disposed outside the photosensitive member 1. However, it may be disposed within the photosensitive member 1, and the placing it in the photosensitive member 1 does not reduce the effects of the present invention. As will be evident from the above description of this embodiment, being able to heat the photosensitive member 1 with no contact between the heating means and the photosensitive member 1 is substantial in merit.

Figure 5:
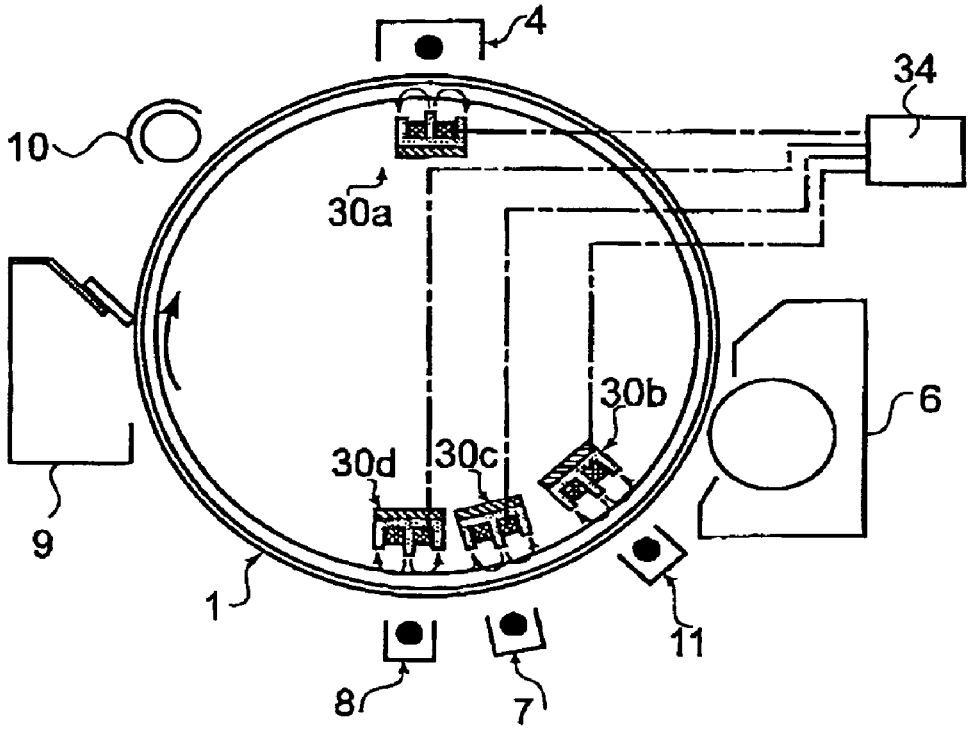
FIG. 5 is a schematic vertical sectional view of the image forming portion of the image forming apparatus, showing the positioning of the magnetic field generating means other than the magnetic field generating means which corresponds to the primary charging device.
Figure 6:
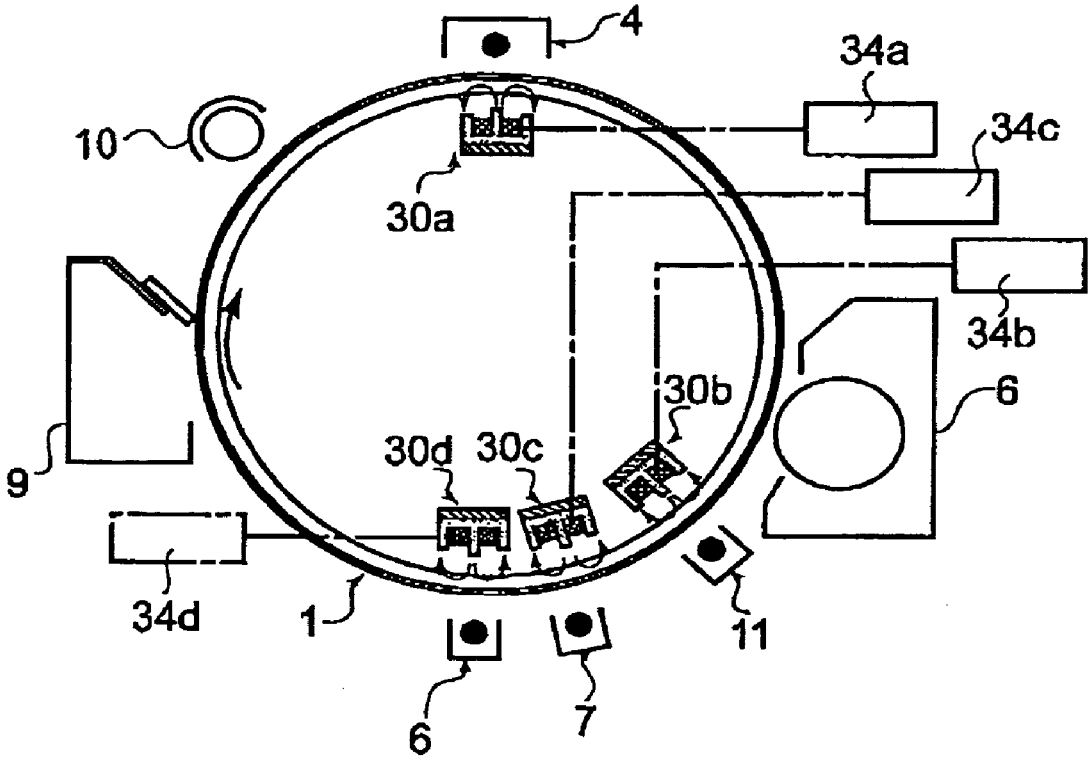
FIG. 6 is a schematic vertical sectional view of the image forming portion of the image forming apparatus which is different from that shown in FIG. 5 in that each of the magnetic field generating means in FIG. 6 has its own high frequency power source.

As for the portions of the image forming apparatus having a charging device, the charging portion 4, transferring portion 7, separating portion 8, and post-charging portion 11 can be listed, as shown in FIG. 2. Referring to FIG. 5, the magnetic field generating means 30*a*, 30*b*, 30*c*, and 30*d* are disposed in the adjacencies of the internal surface of the photosensitive member 1 so that the photosensitive member 1 is positioned between these charging devices 4, 7, 8, and 11 disposed in the adjacencies of the peripheral surface of the photosensitive member 1, and these magnetic field generating means 30*a*, 30*b*, 30*c*, and 30*d*, respectively, in order to locally heat the photosensitive member 1 to locally dry the photosensitive member 1. In the case of this set-up in this embodiment, the high frequency power source 34 can be used for driving all of the magnetic field generating member 30*a*, 30*b*, 30*c*, and 30*d*. Incidentally, the image forming apparatus may be provided with multiple high frequency power sources 34*a*, 34*b*, 34*c*, and 34*d*, instead of a single high frequency power source, that is, the high frequency power source 34, so that the magnetic field generating member 30*a*, 30*b*, 30*c*, and 30*d* are individually driven by their own power sources. Providing each of the magnetic field generating member 30*a*, 30*b*, 30*c*, and 30*d* with its own high frequency power source makes it possible to drive each of them as necessary, making it thereby possible to more precisely control each of them.

In the image forming apparatus in this embodiment, a magnetic field generating means is disposed in the adjacencies of each charging device, and the portions of the photosensitive member, inclusive of their adjacencies, which is facing one of the charging devices, are heated by these magnetic field generating means one for one to be dried by the heat. Therefore, the portions of the peripheral surface of the photosensitive member, which have increased in moisture content due to the adhesion thereto of the byproducts of corona discharge, can be efficiently dried. Therefore, the image forming apparatus in this embodiment can yield satisfactory images from the beginning of an image forming operation while being substantially smaller in energy consumption than an image forming apparatus in accordance with the prior art. Further, the substrate 2 of the photosensitive member 1 is directly heated by the heat electromagnetically induced therein by the magnetic field generating means 30, with no contact between the magnetic field generating means 30 and the photosensitive member 1 which is being rotated. Therefore, not only is the image forming apparatus in this embodiment better in heat generation efficiency, but also, smaller in the load of the motor for driving the photosensitive member 1, and more reliable in terms of the power supply to the photosensitive member heating means, than an image forming apparatus in accordance with the prior art.

Further, the heat generated in the abovementioned portions of the photosensitive member 1 is transmitted throughout the photosensitive member 1 with the substrate 2 playing the role of a heat transmission medium, contributing thereby to reducing the dew formation which occurs when the image forming apparatus is operated in the high humidity environment, when the ambient temperature of the image forming apparatus suddenly changes, or in the like situations.

Embodiment 2

In this embodiment, a temperature detecting means is disposed between a photosensitive member and a magnetic field generating means. The means, members, etc., of the image forming apparatus in this embodiment, which are identical to those in the first embodiment, are given the same referential symbols as those given to describe the first embodiment, and will be not be described here to avoid the repetition of the same descriptions.

Figure 7:
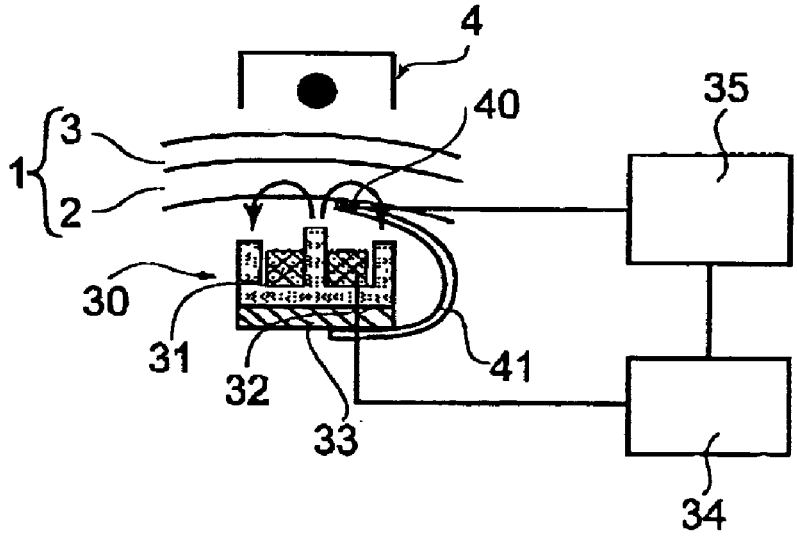
FIG. 7 is a schematic drawing showing an example of the positioning a temperature detecting means, in which a temperature detecting means is disposed between the photosensitive member and magnetic field generating means.

FIG. 7 is a schematic drawing of the photosensitive member heating means in this embodiment, which is similar to that in the first embodiment, except that the one in this embodiment is provided with a temperature detecting means 40, which is disposed between the photosensitive member and magnetic field generating means. In this embodiment, the temperature detecting means 40 is attached to the holder 33 of the magnetic field generating member 30 with the interposition of a supporting member 41, which is an elastic member for ensuring that the temperature detecting means 40 is kept in contact with the internal surface of the photosensitive member 1.

Regarding the temperature level at which toner can be melted for fixation, toner is designed so that it does not melt when it is heated to a temperature level in the range of 40-50° C., for the following reason. When drying the portion of the peripheral surface of the photosensitive member 1, which is facing the charging device (charging device 4 for example), and the adjacencies of this portion, by heating the portions with the use of the magnetic field generating means disposed in the adjacencies of the charging device, it is possible that the portions will be heated to an extremely high temperature by the magnetic field generating means 30 while the photosensitive member 1 is rotated. If the portions in the adjacencies of the primary charging device 4, for example, are heated to an extremely high temperature while the photosensitive member 1 is rotated, it is possible that the toner will become fixed across the portion of the peripheral surface of the photosensitive member 1, which is facing the developing device 6, that is, the next device in terms of the rotational direction of the photosensitive member 1.

Thus, in this embodiment, the temperature of the portion of the substrate 2 of the photosensitive member 1, which is facing the magnetic field generating member 30, is detected by the temperature detecting means 40 so that the driving of the magnetic field generating member 30 can be controlled by turning on or off the high frequency power source 34 by the control circuit 35 in response to the temperature level detected by the temperature detecting means 40. In other words, the magnetic field generating member 30 is controlled so that the temperature of the photosensitive member 1 is kept below the lowest level at which toner fixation is possible. With the employment of this control, it is possible to prevent the above described unwanted toner fixation. Here, toner fixation means the phenomenon that toner particles melt, and then, solidify into a single piece; it includes the phenomenon that the melted toner glues itself to the photosensitive member.

As the temperature detecting means 40, a thermistor, a thermocouple, or the like may be employed. As for where the temperature detecting means 40 is to be attached to detect the temperature of the substrate 2, the temperature detecting means 40 may be disposed in the space between the coil 31 and the photosensitive member 1, with no contact between the temperature detecting means 40 and photosensitive member 1, to detect the temperature in this space. However, placing the temperature detecting means 40 in contact with the internal surface of the photosensitive member 1 is superior, in terms of the accuracy with which the temperature of the photosensitive member 1 is detected, to placing the temperature detecting means 40 in this space.

In this embodiment, the driving of the magnetic field generating means 30 is controlled based on the temperature of the photosensitive member 1 detected by the temperature detecting means 40 while the photosensitive member 1 is rotated. However, it may be based on the temperature of the photosensitive member 1 detected by the temperature detecting means 40 while the photosensitive member 1 is stationary that the driving of the magnetic field generating means 30 is controlled.

Embodiment 3

In this embodiment, the primary charging device 4 is disposed a predetermined angle deviated in the rotational direction of the photosensitive member 1 relative to the vertical line which coincides with the rotational axis of the photosensitive member 1. The means, members, etc., of the image forming apparatus in this embodiment, which are identical to those in the first embodiment, are given the same referential symbols as those given to describe the first embodiment, and will be not be described here to avoid the repetition of the same descriptions.

Figure 8:
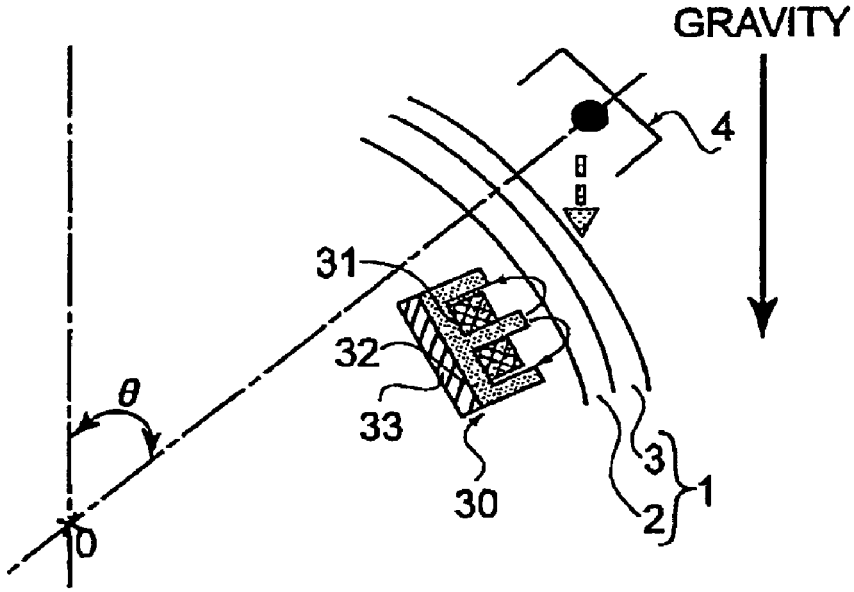
FIG. 8 is a schematic drawing showing the positioning the magnetic field generating means relative to the primary charging device, which is different from the positioning of the magnetic field generating means shown in FIG. 2

FIG. 8 is a schematic drawing of the photosensitive member heating means in this embodiment, showing the positional relationship of the magnetic field generating member 30 relative to the charging device (primary charging device in FIG. 8). The structure of the image forming portion A in this embodiment is the same as that in the first embodiment described with reference to FIG. 2, except that in the case of the image forming portion A in this embodiment, the transfer medium 20 is vertically conveyed, instead of horizontally as shown in FIG. 2. In the cases that the image forming portion A is structured as in this embodiment, it is prevalent that the primary charging device 4 is disposed deviated at a certain angle in the rotational direction of the photosensitive member 1 (or direction counter thereto) from the vertical line V (direction of gravity) which coincides with the rotational axis O of the photosensitive member 1. In such cases, that is, in the cases that there is an angle of θ between the vertical line which coincides with the rotational axis O of the photosensitive member 1 and the line connecting the discharge wire of the charging device 4 and the rotational axis 0 of the photosensitive member 1, moisture will adhere to the portion of the peripheral surface of the photosensitive member 1, which is directly below the charging device 4, that is, the portion located in the direction in which gravity works, because the byproducts of the electrical discharge, which float in the space adjacent to the charging device 4, eventually move downward due to gravity. Thus, in this embodiment, the magnetic field generating member 30 is disposed so that it faces the portion of the peripheral surface of the photosensitive member 1, which is directly below the primary charging device 4, that is, the portion located in the direction in which gravity works. Therefore, it is ensured that the portion of the peripheral surface of the photosensitive member 1, which has been increased in moisture content by the adhesion thereto of the byproducts of the electrical discharge is dried by the heat generated by the magnetic field generating member 30.

Embodiment 4

This embodiment is an example in which a magnetic field generating means is disposed in the adjacencies of such a charging device that charges an object to the negative polarity. The means, members, etc., of the image forming apparatus in this embodiment, which are identical to those in the first embodiment, are given the same referential symbols as those given to describe the first embodiment, and will be not be described here to avoid the repetition of the same descriptions.

Figure 9:
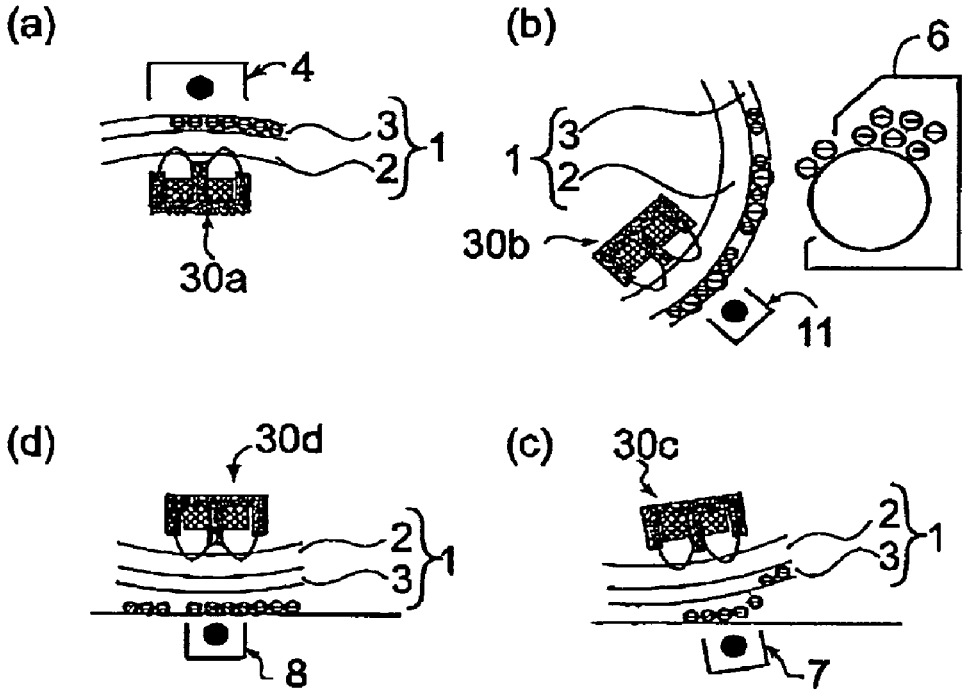
FIG. 9 is a schematic drawing showing an example of the positioning of the magnetic field generating means, in the adjacencies of the corresponding charging devices, one for one, which are negative in the polarity to which they charge an object.
Figure 10:
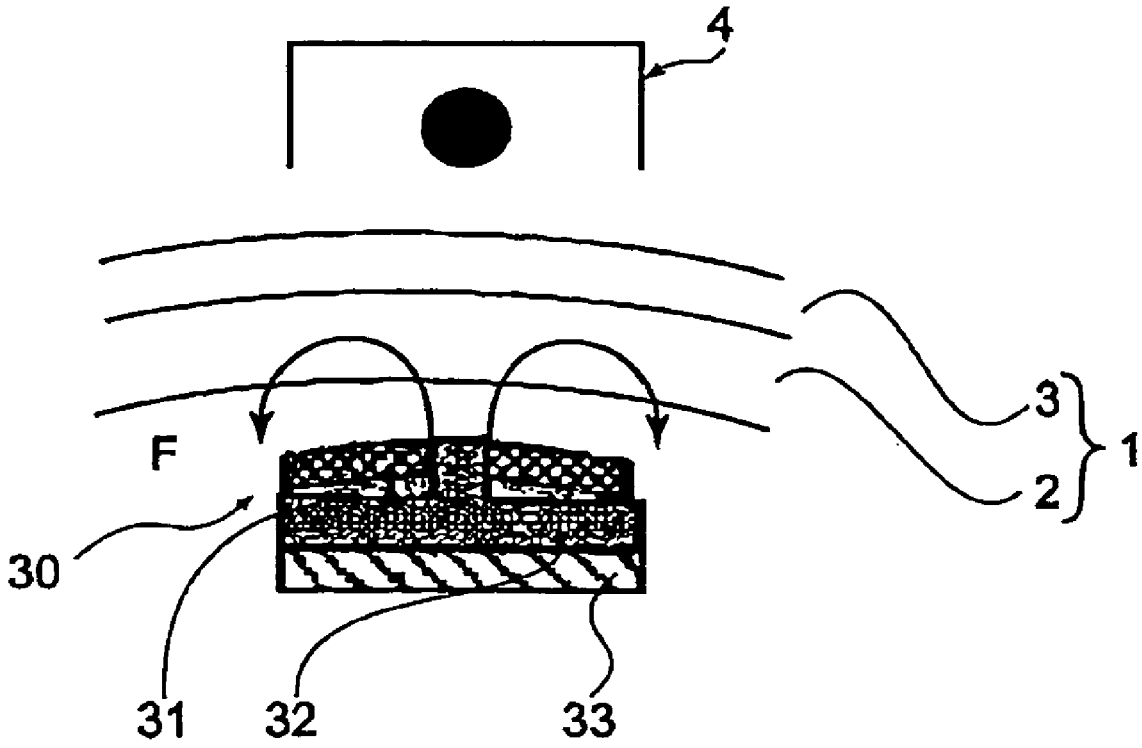
FIG. 10 is a schematic drawing showing another example of a magnetic field generating means, showing the structure thereof.

FIGS. 9(*a*)-9(*d*) are schematic drawings of the magnetic field generating means 30*a*, 30*b*, 30*c*, and 30*d*, which are disposed in the adjacencies of primary charging device 4, transfer charging device 7, separation charging device 8, and post-charging device 11 which charge an object to the negative polarity, showing the general structures thereof. Referring to FIG. 9(*a*), to the primary charging device 4, high voltage is continuously applied to cause the electrical discharge (corona discharge), which generates byproducts. The amount by which byproducts are generated is greater when an object is charged to the negative polarity than when an object is charged to the positive polarity. Sometimes, not only is the primary charging device 4 used to charge an object to the negative polarity, but also, the transfer charging device 7, separation charging device B, and post-charging device 11 (FIGS. 9(*b*), 9(*c*), and 9(*d*), respectively). Which polarity the photosensitive member 1 is charged to by the charging devices is dependent on the polarity of the toner used for development. The magnetic field generating means 30*a*, 30*b*, 30*c*, and 30*d* are disposed within the hollow of the photosensitive member 1, and also, in the adjacencies of the charging devices 4, 7, 8, and 11, so that the photosensitive member 1 is positioned between the charging devices 4, 7, 8, and 11 and the magnetic field generating means 30*a*, 30*b*, 30*c*, and 30*d*, respectively. The method for heating the portions of the peripheral surface of the photosensitive member 1, which are facing the charging devices 4, 7, 8, and 11, with the use of the magnetic field generating means 30*a*, 30*b*, 30*c*, and 30*d*, to dry these portions of the photosensitive member 1 is the same as that in the first embodiment. Therefore, it is possible to always yield images which do not suffer from the aforementioned defects called slur.

The coils of the magnetic field generating means 30 (30*a*-30*d*) in the preceding embodiments of the present invention may be shaped so that their portions which face the substrate 2 are rendered arcuate in contour to roughly match the curvature of the substrate 2. Configuring the coil of the magnetic field generating means 30 in this manner is useful for causing the magnetic flux F to permeate the substrate 2 of the photosensitive member 1 by a larger amount.

(Miscellanies)

1) The choice of the means for heating the photosensitive member 1 does not need to be limited to a magnetic flux generating means. For example, a long and narrow heater capable of heating the portion of the photosensitive member 1, which is facing a charging device, and the adjacencies of this portion of the photosensitive member 1, may be employed as the heating means.

2) The choice of the charging means does not need to be limited to a charging device of the noncontact type. For example, a charging device of the contact type may be employed. As a charging device of the contact type, a charge roller is available, which is placed in contact with the photosensitive member 1 to charge the peripheral surface of the photosensitive member 1.

The choice of the image bearing member does not need to be limited to an image bearing member in the form of a roller. That is, a rotational member other than a cylindrical member, for example, an endless belt or the like, may be employed as the image bearing member.

4) The choice of the temperature detecting means does not need to be limited to a thermistor; all that is required of the temperature detecting means is to be capable of detecting the temperature of a given portion of the photosensitive member 1. Further, the temperature detecting means may be of the contact type or noncontact type.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 312483/2004 filed Oct. 27, 2004 which is hereby incorporated by reference.

What is claimed is:

1. An image forming apparatus comprising:

an image bearing member, including a heat generation layer for generating heat at least by a magnetic flux, for bearing a toner image on a surface thereof;

charging means for charging said image bearing member;

latent image forming means for forming an electrostatic image by exposing said image bearing member after being charged;

developing means for developing the latent image with toner into a toner image;

transferring means for transferring the toner image onto a recording material;

magnetic flux generating means, disposed so as to be spaced from said image bearing member at a position across said image bearing member from said charging means, for generating a magnetic flux toward said image bearing member;

temperature detecting means disposed so as to be contacted to the surface of said image bearing member at a position opposed to said magnetic flux generating means; and control means for controlling electric power supplied to said magnetic flux generating means on the basis of a result of detection of said temperature detecting means.

2. An apparatus according to claim 1, wherein said magnetic flux generating means is disposed vertically below said charging means.

3. An apparatus according to claim 1, further comprising a voltage source for supplying electric power to said magnetic flux generating means, wherein said voltage source is supported separately from said image bearing member.

* * * * *

UNITED STATES PATENT AND TRADEMARK OFFICE

CERTIFICATE OF CORRECTION

PATENT NO. : 7,231,155 B2
APPLICATION NO. : 11/174539
DATED : June 12, 2007
INVENTOR(S) : Hitoshi Suzuki It is certified that error appears in the above-identified patent and that said Letters Patent is hereby corrected as shown below:

ON THE TITLE PAGE:
At Item (54), Title, "POWER CONTROLLED" should read
--POWER-CONTROLLED--.

At Item (56), References Cited, Foreign Patent Documents,

"92229177 A
01211768 A" should read

--62-229177 A
1-211768 A--

"01238677 A
07104638 A
09106137 A" should read

--1-238677 A
7-104638 A
9-106137A--.

COLUMN 1:
Line 2, "POWER CONTROLLED" should read --POWER-CONTROLLED--.

COLUMN 9:
Line 42, "is" should read --are--.

UNITED STATES PATENT AND TRADEMARK OFFICE

CERTIFICATE OF CORRECTION

PATENT NO. : 7,231,155 B2
APPLICATION NO. : 11/174539
DATED : June 12, 2007
INVENTOR(S) : Hitoshi Suzuki It is certified that error appears in the above-identified patent and that said Letters Patent is hereby corrected as shown below:

COLUMN 12:
Line 12, "be" should be deleted.

Signed and Sealed this

Twenty-fifth Day of December, 2007

JON W. DUDAS
*Director of the United States Patent and Trademark Office*